US011365938B2

(12) United States Patent
Strumenti et al.

(10) Patent No.: US 11,365,938 B2
(45) Date of Patent: Jun. 21, 2022

(54) COMBINED CONVECTOR

(71) Applicant: FRIGEL FIRENZE S.P.A., Scandicci (IT)

(72) Inventors: Francesco Strumenti, Monsummano Terme (IT); Filippo Dorin, Florence (IT)

(73) Assignee: FRIGEL FIRENZE S. P. A., Scandicci (IT)

( * ) Notice: Subject to any disclaimer, the term of this patent is extended or adjusted under 35 U.S.C. 154(b) by 366 days.

(21) Appl. No.: 15/310,926

(22) PCT Filed: May 14, 2015

(86) PCT No.: PCT/IB2015/053563
§ 371 (c)(1),
(2) Date: Nov. 14, 2016

(87) PCT Pub. No.: WO2015/173767
PCT Pub. Date: Nov. 19, 2015

(65) Prior Publication Data

US 2017/0082370 A1 Mar. 23, 2017

(30) Foreign Application Priority Data

May 15, 2014 (IT) ..... FI2014A000113

(51) Int. Cl.
*F28D 5/02* (2006.01)
*F28F 19/01* (2006.01)
(Continued)

(52) U.S. Cl.
CPC ..... *F28D 5/02* (2013.01); *F28C 3/08* (2013.01); *F28F 19/01* (2013.01); *F28F 19/02* (2013.01); *F28F 2245/02* (2013.01)

(58) Field of Classification Search
CPC ..... F28D 5/00; F28D 5/02; F28C 1/00; F28C 1/02; F28C 1/04; F28C 1/06; F28C 3/04;
(Continued)

(56) References Cited

U.S. PATENT DOCUMENTS 3,767,176 A * 10/1973 Engalitcheff, Jr. ..... F28C 3/06 261/111
3,865,911 A 2/1975 Lefevre
(Continued)

FOREIGN PATENT DOCUMENTS

AU WO 2005005905 A1 * 1/2005 ..... F24F 5/0035
CH 692 759 A5 10/2002
(Continued)

*Primary Examiner* — Miguel A Diaz
(74) *Attorney, Agent, or Firm* — McGlew and Tuttle, P.C.

(57) ABSTRACT

A convector for air cooling of a fluid flowing in a pipe, comprising: a path for a cooling air flow comprising an inlet from and an outlet towards the environment, a heat exchange section comprising at least one tube bundle defining a heat exchange surface, said section being provided in said path for the air flow, fan means producing said air flow along said path, so that said air flow externally invests said tube bundle on said; heat exchange surface, a humidifying section arranged in said path, upstream of said heat exchange section, where water is atomized to be invested by the air flow, characterized by comprising a wetting device for wetting directly with water a portion of the heat exchange surface of said tube bundle to further cool said portion of tube bundle.

24 Claims, 5 Drawing Sheets

(51) Int. Cl.
*F28C 3/08* (2006.01)
*F28F 19/02* (2006.01)

(58) Field of Classification Search
CPC ..... F28C 3/06; F28C 3/08; F28F 2245/02; F24D 2220/2027; F25J 2205/34
See application file for complete search history.

(56) References Cited

U.S. PATENT DOCUMENTS 4,315,873 A * 2/1982 Smith ..... F28C 1/14 261/158
5,435,382 A * 7/1995 Carter ..... F28C 1/14 165/110
5,701,748 A 12/1997 Phelps et al.
5,724,828 A * 3/1998 Korenic ..... F28C 1/14 165/900
6,142,219 A * 11/2000 Korenic ..... F28C 1/14 165/110
7,128,310 B2 * 10/2006 Mockry ..... F28C 1/14 261/112.1
7,600,743 B2 * 10/2009 Dorin ..... F28B 1/06 165/60
10,132,577 B2 * 11/2018 Martell ..... F28F 27/00
2001/0002620 A1 * 6/2001 Carter ..... F28C 1/14 165/201
2003/0070547 A1 * 4/2003 Hubbard ..... F28C 1/14 95/288
2007/0240445 A1 * 10/2007 Morrison ..... F28C 1/14 62/304
2009/0115080 A1 * 5/2009 Dorin ..... F28B 1/06 261/159
2009/0283245 A1 * 11/2009 Hentschel ..... F28C 1/04 165/100
2010/0101234 A1 * 4/2010 Birkner ..... C09D 1/00 60/806
2010/0263826 A1 * 10/2010 Wiltz ..... F28C 1/02 165/47
2011/0100593 A1 * 5/2011 Benz ..... F28B 1/06 165/59
2013/0008195 A1 * 1/2013 Taljaard ..... F24F 5/0035 62/91
2014/0041834 A1 * 2/2014 Kloeppner ..... F28F 1/00 165/104.13
2014/0166240 A1 * 6/2014 Carter ..... F28D 15/00 165/104.14
2015/0204626 A1 * 7/2015 Martell ..... F28F 27/00 165/200
2015/0276292 A1 * 10/2015 Son ..... F28C 1/00 62/135
2016/0069577 A1 * 3/2016 Dinnage ..... F24F 5/0035 62/121
2017/0074553 A1 * 3/2017 Dinnage ..... F25B 49/00
2017/0082370 A1 * 3/2017 Strumenti ..... F28C 3/08

FOREIGN PATENT DOCUMENTS

DE 10 51 296 B 2/1959
DE 24 21 067 A1 11/1974
DE 2177854 A1 * 4/2010 ..... F25B 39/04
EP 2 397 805 A2 12/2011
WO WO-2005005905 A1 * 1/2005 ..... F24F 5/0035
WO 2007/015281 A2 2/2007

* cited by examiner

-- Prior Art --

10
17
A
A
16A
18
18
24
24
Y
Y
18C
A
11
12≡14
16
21
15C
22
22
15A
15A
23
A
A
20
20
15
D
13
13

COMBINED CONVECTOR

TECHNICAL FIELD

The present invention relates to a convector for air cooling of a fluid flowing in a pipe.

STATE OF THE ART

Nowadays, the convectors currently used for cooling of process fluids, also known as coolers, can be subdivided into the following types, according to the different operation modes: i) dry, ii) evaporative, and iii) adiabatic coolers.

Dry-coolers are air coolers, i.e. heat exchangers with tube bundle, wherein the process fluid flows inside finned tubes and is cooled by means of air that, forced by one or more fans, flows at room temperature, without mains water consumption. The cooling capability of these coolers depends on the temperature difference between air and fluid as well as on the airflow. The temperature at which the process fluid exits the convector is limited by the dry-bulb temperature of ambient air.

Evaporative coolers are air coolers, i.e. heat exchanger with finned tube bundle, wherein a nozzle ramp atomizes, under high pressure, water coming from an outer source, so as to make it directly evaporate on the fins of the fluid cooling battery.

The temperature at which the process fluid exits the convector is limited by the wet-bulb temperature of air. Evaporative coolers are high performing in terms of both cooling capability and temperature at which the process fluid exits the convector. However, these coolers are subject to some problems like deposits and/or corrosion, that quickly degrade the performances of the coolers and require expensive maintenance; in fact, the evaporating water leaves, on the tube bundle and on the fins, its salt content, usually limescale and other salts.

To overcome these problems and increase the life of the system, it is possible preventively to treat the water supplied to the nozzle ramp so as to soften it, what however implies high costs and risk of corrosion. Moreover, there are also problems linked to the dispersion into air of sprays that could involve a risk of lethal infections for people (e.g. Legionnaires' disease).

Adiabatic coolers are air coolers, i.e. heat exchangers with finned tube bundle, wherein the air flow, before it passes through the cooling battery, is moistened passing through a pack of water wet filters or, preferably, through a closed chamber, like the adiabatic chamber, as described, for instance, in the patent application WO2007/015281.

The main advantage of adiabatic coolers with respect to evaporative coolers is that it is not necessary to soften the mains water used to moisten the air entering the battery: in fact, the humidifying packs also act as drops separators, absorbing the water and preventing it from achieving the fins of the cooling battery.

A limit of the adiabatic coolers is that, given the same cooling capability, the water consumption is higher (significantly higher in systems without adiabatic chamber): water that does not evaporate inside the air flow falls inside a collection basin; then, it can be discharged and not recovered, or it can be recovered in an accumulation tank and then supplied again to the humidifying packs; however, in systems with water recovery it is necessary to perform the so-called blow-down, i.e. it is necessary to discharge a certain percentage of recirculation water to avoid continuous increase in salt content like in a usual evaporative tower.

The temperature at which the fluid exits the convector is limited by the wet-bulb temperature of air as well as by the efficiency of the adiabatic humidifying system, that in turn depends on the temperature difference between moistened air and fluid to be cooled as well as on the airflow.

FIG. 1 shows the temperature profile of the process fluid (F) and the air (A) inside the exchanger of an adiabatic convector: on the x-axis there is indicated the exchange surface percentage of the finned tube bundle (wherein I indicates the fluid inlet into the finned tube bundle, U indicates the fluid outlet from the finned tube bundle); on the y-axis there are indicated the temperatures of process fluid and air (wherein $T_S$ indicates the temperature at which the process fluid exits); the diagram shows the temperature decrease K of the air entering the finned tube bundle, that is due to humidifying: the temperature passes from the room temperature ($T_A$)—for instance 35° C. in hot climate—up to a temperature higher, by few degrees, than the wet-bulb temperature ($W_B$)—for instance 30° C. The temperature of the air (A) transversally crossing the battery is shown as constant for the sake of simplicity of the diagram. Actually, the temperature of the air A obviously increases passing through the finned pack.

The patent documents DE2421067, DE1051296, EP2397805 and CH692759 disclose further examples of convectors.

OBJECT AND SUMMARY OF THE INVENTION

An object of the present invention is to overcome the limits of the known convectors or coolers.

More in particular, an important object of the present invention is to provide a convector for air cooling of a fluid flowing in a pipe, suitable to make the process fluid achieve low temperatures with reduced water consumption with respect to the evaporative coolers.

A further object of the present invention is to provide a convector, whose cooling battery has a long life.

A further object of the present invention is to provide a convector that is highly reliable and easy to be maintained.

A further object of the present invention is to provide a convector without mains water softening.

A further object of the present invention is to provide a convector that, given the same cooling capability, has greater heat exchange yield, greater efficiency and lower consumption.

A further object of the present invention is to provide a convector having a modular structure allowing easily to expand the cooling capability.

A further object of the present invention is to provide a convector allowing to recover excess water.

A further object of the present invention is to provide a convector without dispersion into air of air/water sprays.

These and other objects, that will be better described below, are achieved through a convector for air cooling of a fluid flowing in a pipe, according to claim 1 below.

For instance, the convector according to claim 1 comprises:

at least one path for a cooling air flow comprising an inlet from and an outlet towards the environment, at least a heat exchange section comprising at least one tube bundle defining a heat exchange surface, this section being provided in said path for the cooling air flow, fan means producing the air flow along this at least one path, so that the air flow externally invests the tube bundle on the heat exchange surface, at least one humidifying section arranged in the air flow path, upstream of the heat exchange section, where water is atomized to be invested by the air flow.

The convector is characterized by comprising a wetting device for wetting directly with water a portion of the heat exchange surface of the tube bundle to further cool this portion of tube bundle.

"Industrial process" means a plant or machinery requiring heat dissipation by means of a fluid, such as a plastics processing plant, an oleodynamic station, a condenser for water-cooled chillers etcetera.

"Process fluid" means for instance a liquid, like water or mixtures of water and antifreeze.

"Tube bundle" or "finned tube bundle" or "finned pack" or "battery" or "finned battery" means a known heat exchange system having tubes, inside which the process fluid flows surrounded by surface structures suitable to increase the heat exchange surface, like fins (or other equivalent structures) for heat exchange with the air externally investing the tube bundle (tubes and fins). For example, the tube bundle can be comprised of one or more batteries, or finned packs, connected in series and/or in parallel.

"Exchange surface" means the overall exchange surface of the tube bundle, i.e. of one or more batteries or finned packs connected in series and/or in parallel indifferently.

The humidifying section preferably provides an adiabatic, or substantially adiabatic, chamber where water is atomized to be invested by the air flow that then achieves the tube bundle.

The tube bundle is adequately provided with an entrance side, for the fluid to be cooled to enter the tube bundle, and with an exit side, other than the entrance one, for the fluid to exit the tube bundle, so that the cooling fluid has an overall flowing direction from the entrance side to the exit side.

Adequately, with reference to this overall flowing direction, the heat exchange surface portion of the tube bundle that can be wet by this device is the end part of the tube bundle. Therefore, the device is preferably arranged substantially along the end part of the tube bundle, i.e. towards the exit side for the process fluid.

The tube bundle has preferably tubes or ducts, wherein the fluid flows, comprised of segments that are all directed from the entrance side towards the exit side of the tube bundle (these tubes are preferably rectilinear).

Practically, the tube bundle or pack or finned battery, or the combination of packs and finned batteries, are single-passage, and the fluid flows in the tube bundle in a single direction, from the process inlet towards the outlet. Practically, the heat exchange surface increases from the entrance of the fluid into, to the exit of the fluid from, the tube bundle; this increase is progressive in a given direction of the tube bundle, from the entrance side towards the opposite exit side.

The temperature required for the process fluid is achieved on the exit side from the tube bundle.

According to preferred embodiments, the wetting device for wetting directly with water a portion of the heat exchange surface of the tube bundle comprises adjusting means for regulating the wettable width of this portion, so that this portion can be wet from a minimum or null dimension up to a maximum dimension different than the overall dimension of the heat exchange surface of the tube bundle.

Practically, it is possible to regulate how much heat exchange surface shall be wet, adequately near the final portion thereof, cooling the process fluid, optimizing the water flow according to the required cooling capability, and avoiding, at the same time, water dispersion into the environment.

Advantageously, the wetting device for wetting the tube bundle portion comprises at least one water nozzle operatively connected to a hydraulic system and directed to wet this portion of the tube bundle. The device preferably comprises a plurality of water, nozzles connected to the hydraulic system, each nozzle being suitable to wet a respective part of the heat exchange surface of the tube bundle; the adjusting means for regulating the wettable width comprise valve means suitable to intercept selectively the water flowsfor towards the nozzles.

The nozzles can be connected to the hydraulic system in series and/or in parallel, or according to other configurations, depending on the needs. The valve means comprise, for example, solenoid valves that close tube segments by means of more nozzles or by means of single nozzles.

According to preferred embodiments, the at least one nozzle and the tube bundle are designed so that the water from the nozzle wetting the tube bundle creates on the same bundle a substantially homogeneous water film. Preferably, the tube bundle has a high-wettability surface coating allowing said homogeneous film to be formed; this coating is preferably an hydrophilic paint, preferably of the acrylic type.

Practically, the tube bundle is preferably treated with a special surface coating, so that the water, that plenty wets the tube bundle, creates on the same tube bundle a homogeneous film, so that the water does not evaporate directly on the tube bundle and thus does not cover it with salts; in other words, the outer surface layer of the water film is made evaporate, thus cooling the inner layer that is into contact with the finned tubes and that, in turn, exchanges heat with the fins through conduction; the water percentage wetting the tube bundle without evaporating preferably falls, due to gravity, inside the adiabatic chamber; here, it partially evaporates, further increasing the humidifying efficiency; the excess water, i.e. the part of water that wets the battery and does not evaporate even inside the adiabatic chamber, absorbs the salts of the evaporated part and can be discharged or recovered.

The convector according to the invention can therefore also comprise recovery means for recovering water coming from the wetting device for wetting the portion of tube bundle; and these means comprise a system for supply the recovered water to the humidifying system of the humidifying section.

According to a preferred embodiment of the invention, the convector comprises control means for controlling the water flow supplied to the nozzles and/or the temperature of the process fluid and/or the airflow generated by the fans, in order to optimize the energy consumption according to the required cooling capability and to avoid water dispersion into the environment.

Therefore, control means can be provided for controlling the water flow supplied by said at least one nozzle according to process parameters comprising at least one of the following: temperature of the process fluid flowing in the tube bundle measured at one or more points, air flow generated by said fan means, temperature and humidity of the external environment, humidity in said humidifying section.

Therefore, management means can be provided for managing the water flow atomized in said humidifying section according to process parameters comprising at least one of the following: temperature of the process fluid flowing in the tube bundle measured at one or more points, air flow generated by said fan means, temperature and humidity of the external environment, humidity in said humidifying section, water flow supplied by said means for wetting the tube bundle.

Moreover, adjusting means can be therefore provided to regulate the airflow emitted by said fan means according to process parameters comprising at least one of the following: temperature of the process fluid flowing in the tube bundle measured at one or more points, temperature and humidity of the external environment, humidity in said humidifying section, water flow supplied by said means for wetting the tube bundle, humidity in said humidifying section.

According to preferred embodiments, the convector according to the invention has a structure with at least one lower chamber, defining the humidifying section, above which there is an upper chamber, where there is the heat exchange section; the fan means are arranged above the upper chamber, wherein the air flows from the bottom upwards.

The lower chamber is an adiabatic, or substantially adiabatic, chamber and contains at least one evaporation filter (preferably at least two filters, one of which associated with at least one air inlet into the chamber, and one of which associated with the air outlet from the chamber), like for example a honeycomb fill pack suitable to be moistened, i.e. wetted. The air crossing the filter and the chamber vaporizes the water entered the same chamber and transfers to it the evaporation heat, thus becoming cool before crossing the following heat exchange section (i.e. before crossing the tube bundle).

In preferred embodiments, in the chamber there are two side inlets for the air, two first evaporation filters associated with these two inlets, and one second evaporation filter associated with the outlet of the lower chamber and, of course, with the inlet of the upper chamber, as the outlet of the lower chamber and the inlet of the upper chamber substantially match. The two first evaporation filters are preferably arranged like a V, i.e. they are inclined form the center of the lower chamber towards the sides of it and upwards. The second filter is preferably horizontal or substantially horizontal.

The humidifying section adequately comprises humidifying means for humidifying the filters, that are provided with water ejectors operatively connected to a hydraulic system and arranged above at least one first filter.

According to preferred embodiments, the upper chamber comprises at least one tube bundle, arranged preferably inclined, and one wetting device arranged above the same tube bundle to wet it. There are preferably at least two tube bundles arranged like a V, i.e. are inclined upwards form the center of the upper chamber.

Adequately, according to preferred embodiments, the water—wetting the tube bundle and coming from the wetting device to wet it preferably forming a homogeneous film on it—that has not evaporated, falls due to gravity on the outlet for the air exiting the lower chamber, i.e. on the inlet for the air entering the upper chamber; this water preferably wets one or more evaporation filters arranged in the lower chamber.

In other embodiments, the excess water that has not evaporated is collected under the at least one tube bundle by means of recovery means and then, by means of a recovery water supply system, it is supplied again to the humidifying system of the humidifying section suitable to wet the evaporation filters.

According to preferred embodiments, the convector is comprised of modules that can be connected to one another; each of these modules comprises one said path for a cooling air flow, one said heat exchange section, said fan means, one said humidifying section; at least one of these modules forming the convector has also one said wetting device for wetting directly with water a portion of the heat exchange surface of said tube bundle.

The at least one tube bundle defining the overall heat exchange surface of the convector preferably crosses all the connected modules.

The wetting device for wetting the tube bundle can be integrated only in some modules, preferably in the last modules, so that, by connecting the final modules, the device can wet them. In other embodiments the wetting device for wetting the tube bundle can be associated with the set of the modules already connected to one another.

A further object of the present invention is a method for air cooling of a liquid flowing in a pipe according to claim 13.

This method comprises the following steps:

making the liquid flow inside an air/liquid heat exchanger in a single flowing direction, so that the heat exchange surface increases from the entrance of the liquid into the exchanger to the exit of the liquid from the exchanger, making an air flow taken from the environment flowing onto the heat exchange surface, humidifying said air flow, inside at least one adiabatic or substantially adiabatic chamber, with vaporized or atomized water, said air flow being suitable to invest said vaporized or atomized water, before investing the heat exchanger, to decrease the air flow temperature, wetting the final portion of the heat exchange surface.

"Final portion" means for example the part of heat exchange surface that is comprised between the half of the heat exchanger and the exit side for the liquid to be cooled to exit the heat exchanger.

Preferably, it is possible to adjust the wettable width of the heat exchange surface, i.e. to regulate how much heat exchange surface shall be wet.

The portion of heat exchange surface is preferably wet forming a substantially homogeneous water film.

BRIEF DESCRIPTION OF THE DRAWINGS

Further characteristics and advantages of the present invention will be more apparent from the description of a preferred, although not exclusive, embodiment, illustrated by way of non-limiting example in the attached tables of drawings, wherein.

DETAILED DESCRIPTION OF AN EMBODIMENT OF THE INVENTION

Figure 1:
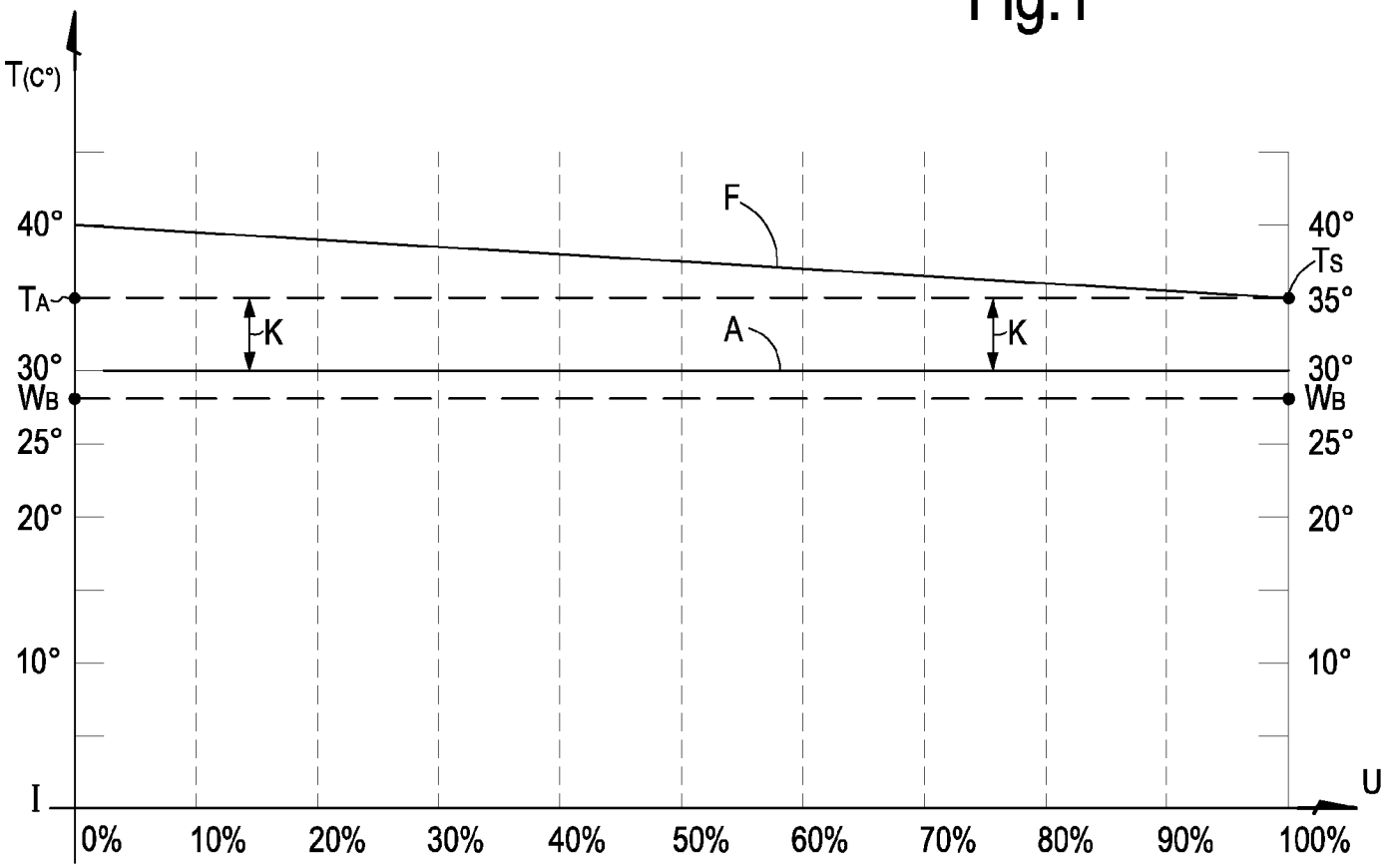
FIG. 1 is a graph showing the temperature profile of process fluid and air inside the exchanger of a known adiabatic convector.

With reference to the above cited figures, a convector for air cooling of a fluid flowing in a tube, according to the invention, is indicated as a whole with number 10.

This convector 10 is comprised of five modules 11, connected in series. Each module 11 comprises an outer case 12 provided with supports 13 for resting on the ground and with walls 14.

Each module 11 substantially defines two chambers, a lower chamber 15 and an upper chamber 16, defined directly above the lower chamber 15.

Figure 3:
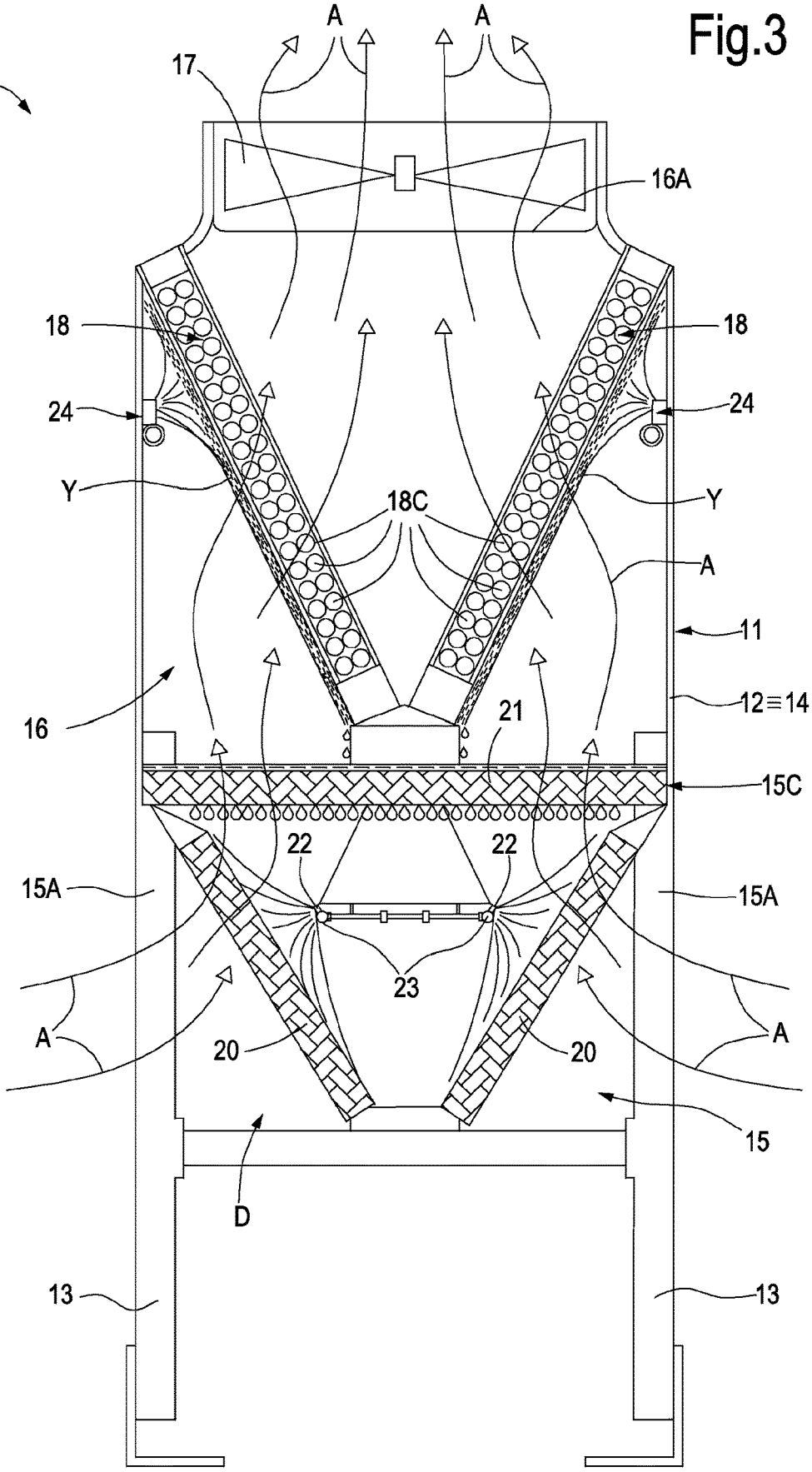
FIG. 3 is a schematic cut-away front view of the convector of FIG. 2.

The lower chamber 15 has side inlets 15A (see FIG. 3) (and/or inlets in the chamber base) so that the air (indicated by the letter a) can enter from the outer environment. The upper chamber 16 has an upper outlet 16A, with which fan means are associated, for example a fan with vertical axis 17, to allow the air coming from the side inlets 15A to exit, forced by the fan. Between the lower chamber 15 and the upper chamber 16 passages are defined to allow the air A to flow through.

Practically, inside each module a path is defined for the air A from the side inlets 15A towards the exit (upper outlet) 16A.

In the upper chambers 16 the heat exchange section of the convector is defined, comprising a pair of finned tube bundles 18 (or finned packs or finned batteries) inside which the process fluid to be cooled flows and which extend along all the upper chambers. The two tube bundles 18 are arranged like a V, i.e. they are inclined upwards form the center of the upper chambers. The type of tube bundles 18 and the way they are arranged in the upper chambers corresponds for instance to those described in the patent application WO2007/15281, to which reference shall be made.

The finned tube bundles 18 have, at their own ends, respective inlet manifolds 19A and outlet manifolds 19B for the fluid to be cooled, that are operatively connected to corresponding parts of the plant where the fluid operates. Practically, the two tube bundles 18 are in parallel (with common inlet and outlet, i.e. the fluids flow inside them with analogous temperature patterns from the inlet to the outlet).

A section D for humidifying the air flow is defined in the lower chamber 15 of each module 11. The air crossing the chamber 15, vaporizing the water (for instance mains water, filtered, not softened, having for example the typical service temperature of the water mains that, depending upon the environmental conditions, is comprised for instance between 10° C. and 30° C.) fed to the same chamber 15, transfers to it the evaporation heat, thus becoming cool before crossing the following heat exchange section.

Adequately, evaporation filters (for instance in the form of honeycomb fill packs similar to those described in the patent application WO2007/015281) are also arranged in this lower chamber 15. For example, there are two first evaporation filters 20, associated with two side inlets 15A, and a second evaporation filter 21, associated with the outlet 15C for the air exiting the lower chamber 15, i.e. associated also with the inlet of the upper chamber 16, as the outlet for the air to exit the lower chamber 15 and the inlet for the air to enter the upper chamber 16 substantially match.

The two first evaporation filters 20 are arranged like a V, i.e. they are inclined upwards form the center of the lower chamber.

The second evaporation filter 21 is preferably horizontal or substantially horizontal, and is interposed between the lower chamber 15 and the upper chamber 16.

Adequately, the humidifying section D comprises humidifying means for the evaporation filters. These humidifying means provide, for example, water ejectors 22, operatively connected to a hydraulic system 23 and arranged above the first evaporation filters 20.

Adequately, the lower chamber 15 is an adiabatic, or substantially adiabatic, chamber, similarly to what described in WO2007/015281.

The convector advantageously comprises a device 24 for wetting directly with water (for instance water from the mains, filtered, not softened, having for example the typical service temperature of the water mains that, depending upon the environmental conditions, is comprised for instance between 10° C. and 30° C.) a portion of the heat exchange surface of the tube bundles 18.

Adequately, each tube bundle 18 is provided with an entrance side 18A for the fluid to be cooled to enter the tube bundle and with an opposite exit side 18B, so that the cooling fluid has an overall flowing direction X from the entrance side to the exit side of the tube bundle.

It should be noted that the portion H of the heat exchange surface of the tube bundles 18 that can be wet by said device is the end part of the tube bundles, with reference to the overall flowing direction. The device 24 is therefore substantially arranged along the end part of the tube bundles, i.e. towards the exit side for the process fluid.

The tube bundles 18 have preferably tubes 18C or ducts where the fluid flows, comprised of segments that are all directed from the entrance side towards the exit side of the tube bundle, and are preferably rectilinear. Practically, the pack or finned battery 18, or the combination of packs and finned batteries, are of the single-passage type, and the fluid flows through the tube bundle 18 in a single direction X, from the entrance to the exit, from the process inlet towards the outlet. Practically, the heat exchange surface increases from the entrance of the fluid into, to the exit of the fluid from, the tube bundle; this increase is progressive in a given direction of the tube bundle, from the entrance side 18A towards the opposite exit side 18B.

The desired temperature of the process fluid is achieved on the exit side 18B of the tube bundles.

Figure 5:
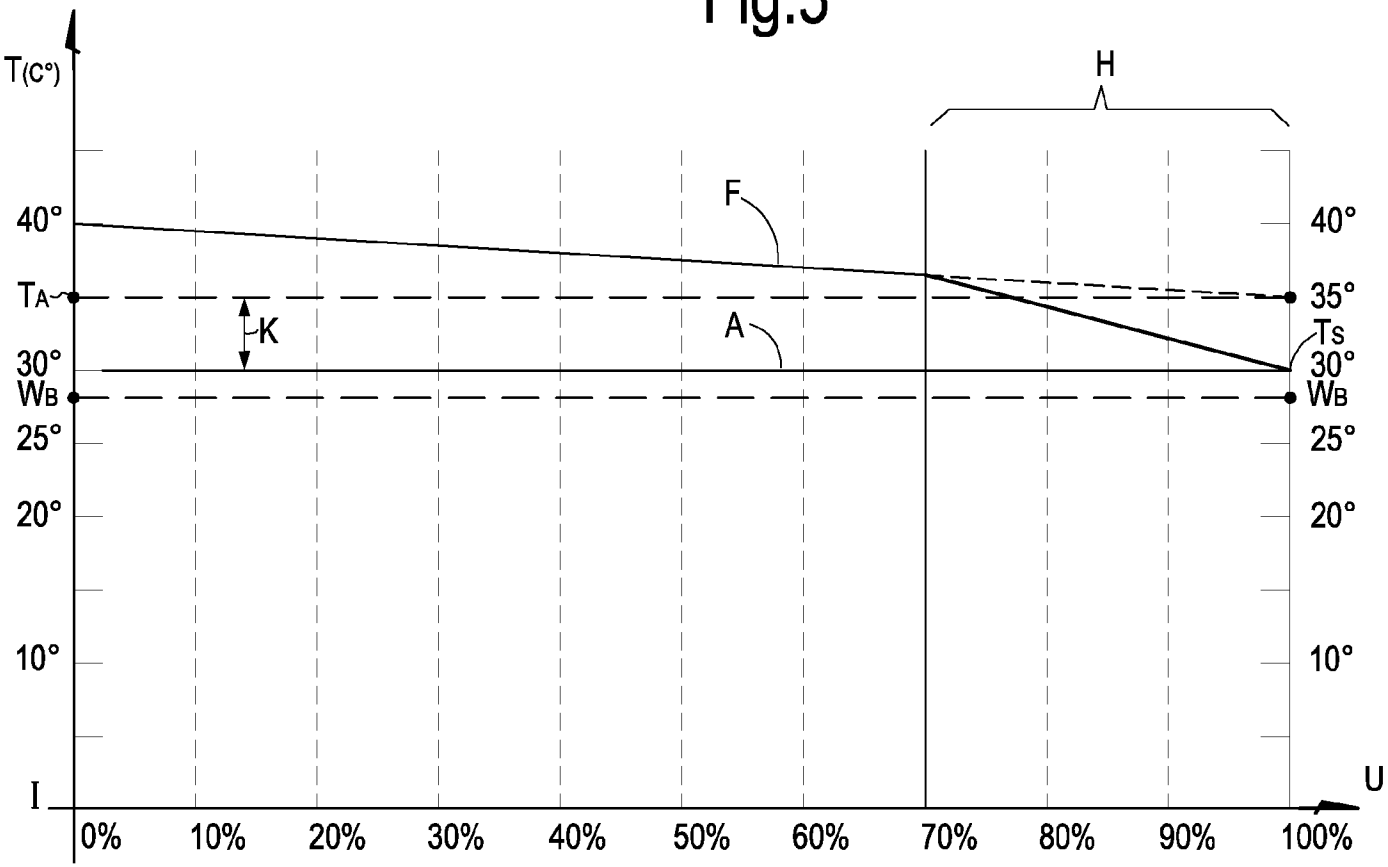
FIG. 5 is a graph showing the temperature profile of process fluid and air inside the exchanger of a convector according to the invention.

FIGS. 1 and 5 show the temperature profiles of the process fluid (F) and the air (A) inside the exchanger of a traditional adiabatic convector, compared with those of a combined adiabatic, evaporation cooler according to the invention. On the x-axis there are the percentages of exchange surface of the finned tube bundles, on the y-axis the temperatures of process fluid and air; the diagrams show the temperature decrease of the air entering the battery, that is due to humidifying: the temperature passes from the room temperature ($T_A$)—for instance 35° C. in hot climate—up to a temperature higher, by few degrees, than the wet-bulb temperature ($W_B$)—for instance 30° C.

The temperature of the air (A) transversally crossing the battery is shown as constant for the sake of simplicity of the diagram. Actually, the temperature of air A naturally increases passing through the finned pack.

The diagram of FIG. 1, corresponding to the adiabatic cooler, shows that the yield of the air/fluid convective heat exchange decreases towards the exchanger exit, as the temperature difference between air and process fluid decreases.

The diagram of FIG. 5, corresponding to the invention, shows the advantages of the wetting device for wetting the partial portion of width H of the finned pack 18 together with the adiabatic chamber 15A, both in terms of performances, allowing to achieve exit temperature ($T_s$) for the process fluid almost equal to the wet-bulb temperature ($W_B$) of the air—for example 30° C. in hot climate—and in terms of efficiency, as the end portion of the battery 18 is wet, i.e. the portion with lower yield of the air/fluid convective heat exchange.

The diagram of FIG. 5 also shows the temperature changes according to different percentages of overall heat exchange surface.

it is therefore clearly apparent that, by varying the dimensions of the wet heat exchange surface, it is possible to optimize the exit temperature ($T_s$) of the process fluid, thus optimizing water consumption, given the same cooling capability.

For this reason, the wetting device 24 for wetting directly with water a portion of the heat exchange surface of the tube bundles 18 comprises adjusting means 25 for regulating the wettable width H of this portion, so that this portion can be wet from a minimum or null dimension up to a maximum dimension different than the overall dimension of the heat exchange surface of the tube bundle.

Practically, it is possible to regulate how much heat exchange surface shall be wet, cooling the process fluid, optimizing the water flow according to the required cooling capability, and avoiding, at the same time, water dispersion into the environment.

These adjusting means 25 comprise a plurality of nozzles 26 connected to a hydraulic system 27 (for example hydraulically connected to the water mains), wherein each nozzle is so directed as to wet a respective part of the heat exchange surface of the tube bundle; the adjusting means 25 also comprise valve means 28 selectively to intercept the water flows to the nozzles.

Figure 2:
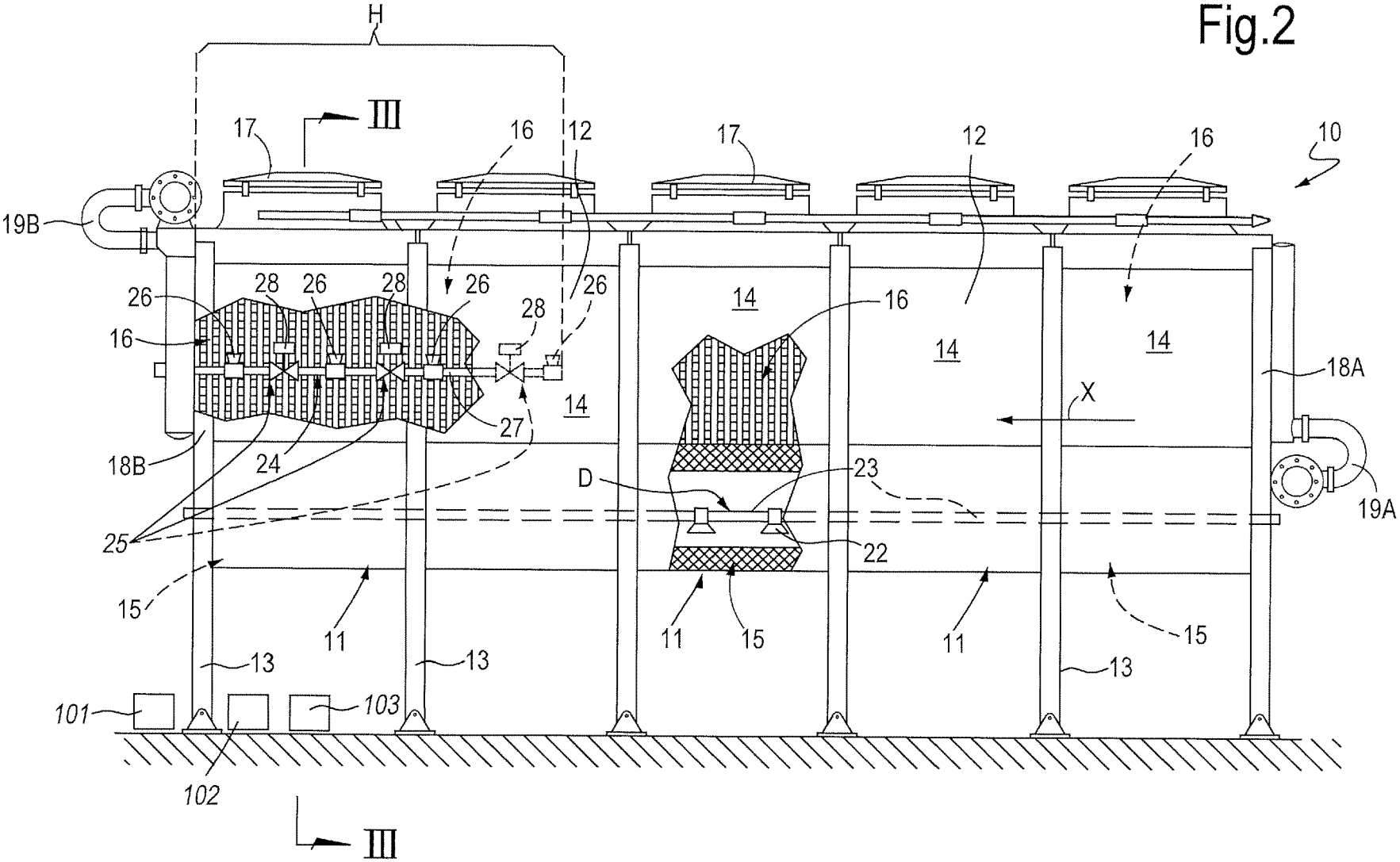
FIG. 2 is a schematic side view of a convector according to the invention.

The nozzles 26 can be connected to the hydraulic system 27 in series and/or in parallel, or according to other configurations depending on the needs. In FIG. 2, the nozzles are arranged in series along a common tube. The valve means 28 are, for instance, solenoid valves that close segments of tubes by means of more nozzles or by means of single nozzles. In FIG. 2, the valve means are solenoid valves that close and open the segment before a respective nozzle 26.

The nozzles 26 and the tube bundles are configured so that the water, coming from the nozzles and wetting the tube bundles, creates on these latter a substantially homogeneous water film Y. The tube bundles have preferably a high-wettability surface coating allowing this homogeneous film to be formed; this coating is, for example, a hydrophilic paint, preferably of the acrylic type.

Practically, the tube bundles 18 are treated with a special surface coating, so that the water, that plenty wets the tube bundles, creates on them a homogeneous film, so that the water does not evaporate directly on the tube bundles 18 and, thus, does not cover them with salts; in other words, the outer surface layer of the water film is made evaporate, thus cooling the inner layer that is into contact with the finned tubes 18 and that, in turn, exchanges heat with the fins through conduction.

The percentage of water, coming from the nozzles 26, that wets the tube bundles without evaporating, falls due to gravity (through the second evaporation filter) inside the adiabatic chamber 15; here, it partially evaporates, further increasing the humidifying efficiency; the excess water, i.e. the part of water that wets the battery 18 and does not evaporate even inside the adiabatic chamber 15, absorbs the salts of the evaporated part and can be discharged or recovered.

Figure 4:
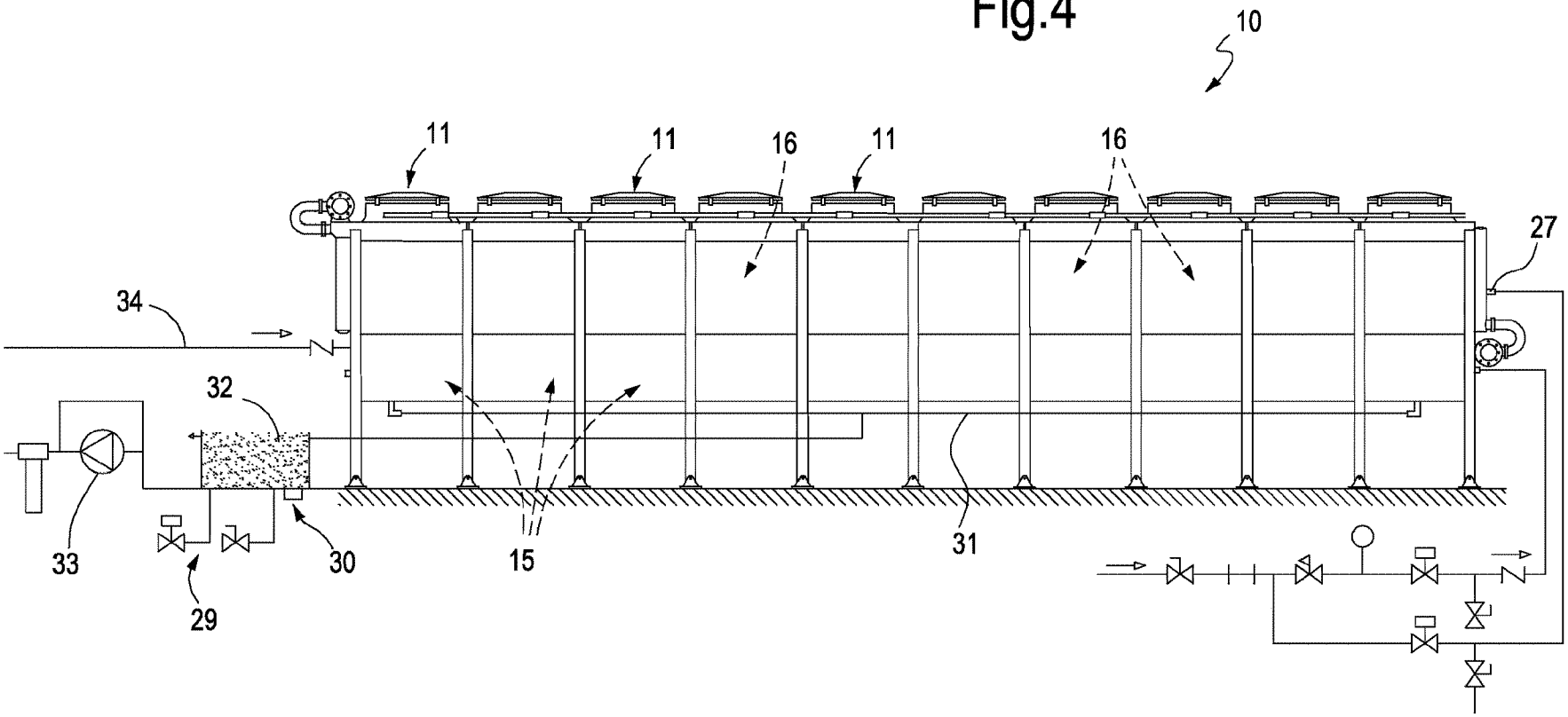
FIG. 4 is a schematic side view of a convector according to the invention, showing a recovery system for the water used to wet the tube bundles, according to the invention.

FIG. 4 shows a convector according to the invention, similar to that shown in FIG. 2, with more modules 11, with recovery means 29 to recover the water coming from the wetting device 24; these recovery means comprise a supply system 30 that supplies the recovered water again to the humidifying system of the humidifying section. This convector comprises, for example, a first pipe 31 connected to the bottom of the lower chambers 15 and leading to a collection tank 32 (provided with a discharge outlet to discharge the part with too much salt) that is, in turn, connected to a pump 33 that pumps the water through a second pipe 34 into the humidifying system of the humidifying section.

Adequately, the convector according to the invention comprises control means (not shown in the figures) for controlling the water flow supplied to the nozzles 26 and/or the temperature of the process fluid and/or the airflow generated by the fans, in order to optimize the energy consumption according to the required cooling capability and to avoid water dispersion into the environment.

Control means 101 can be therefore provided for controlling the water flow supplied by said at least one nozzle according to process parameters, as well as management means 102 for managing the water flow atomized in said humidifying section.

Moreover, airflow adjusting means 103 can be therefore provided to regulate the airflow emitted by said fan means according to process parameters comprising at least one of the following: temperature of the process fluid flowing in the tube bundle measured at one or more points, temperature and humidity of the external environment, humidity in said humidifying section, water flow supplied by said means for wetting the tube bundle.

According to preferred embodiments, the convector according to the invention has a structure with at least one lower chamber, defining the humidifying section, above which there is an upper chamber, where there is the heat exchange section; the fan means are arranged above the upper chamber, wherein the air flows from the bottom upwards.

The lower chamber is an adiabatic, or substantially adiabatic, chamber and contains at least one evaporation filter (preferably at least two filters, one of which associated with at least one air inlet into the chamber, and one of which associated with the air outlet from the chamber), like for example a honeycomb fill pack suitable to be moistened, i.e. wetted. The air crossing the filter and the chamber vaporizes the water entered the same chamber and transfers to it the evaporation heat, thus becoming cool before crossing the following heat exchange section (i.e. before crossing the tube bundle).

In preferred embodiments, in the chamber there are two side inlets for the air, two first evaporation filters associated with these two inlets, and one second evaporation filter associated with the outlet of the lower chamber and, of course, with the inlet of the upper chamber, as the outlet of the lower chamber and the inlet of the upper chamber substantially match. The two first evaporation filters are preferably arranged like a V, i.e. they are inclined form the center of the lower chamber towards the sides of it and upwards. The second filter is preferably horizontal or substantially horizontal.

The humidifying section adequately comprises humidifying means for humidifying the filters, that are provided with water ejectors operatively connected to a hydraulic system and arranged above at least one first filter.

According to preferred embodiments, the upper chamber comprises at least one tube bundle, arranged preferably inclined, and one wetting device arranged above the same tube bundle to wet it. There are preferably at least two tube bundles arranged like a V, i.e. are inclined upwards form the center of the upper chamber.

Adequately, according to preferred embodiments, the water—wetting the tube bundle and coming from the wetting device to wet it preferably forming a homogeneous film on it—that has not evaporated, falls due to gravity on the outlet for the air exiting the lower chamber, i.e. on the inlet for the air entering the upper chamber; this water preferably wets one or more evaporation filters arranged in the lower chamber.

In other embodiments, the excess water that has not evaporated is collected under the at least one tube bundle by means of recovery means and then, by means of a recovery water supply system, it is supplied again to the humidifying system of the humidifying section suitable to wet the evaporation filters.

According to preferred embodiments, the convector is comprised of modules that can be connected to one another; each of these modules comprises one said path for a cooling air flow, one said heat exchange section, said fan means, one said humidifying section, and one said wetting device for wetting directly with water a portion of the heat exchange surface of said tube bundle; at least one module of the set of modules forming the convector also has a humidifying section.

Preferably, the tube bundles of each module are operatively connected to one another, thus forming an overall tube bundle defining the overall heat exchange surface of the convector.

The wetting device for wetting the tube bundle can be integrated only in some modules, preferably in the last modules, so that, by connecting the final modules, the device can wet them. In other embodiments the wetting device for wetting the tube bundle can be associated with the set of the modules already connected to one another.

The main advantages of the convector according to the invention with respect to the prior art are summarized below:

possibility to achieve low exit temperatures (ts) for the process fluid—for example 30° C. in hot climate—with reduced water consumption with respect to the evaporative coolers, thanks to the adiabatic chamber and the possibility to partition the battery washing surface;

long life of the cooling battery;

greater reliability and easiness of maintenance;

no need for softening the mains water;

greater heat exchange yield, greater efficiency and lower consumption, given the same cooling capability;

modularity, wherein the cooling capability can be easily increased;

possibility of excess water recovery, to use it inside the adiabatic chamber until it has completely evaporated in the air flow, thus minimizing the blow-down and avoiding stagnant water in the convector; in fact, due to the high salt content, this water cannot be used for a second passage on the battery, but it can be used in the adiabatic chamber;

no air/water spray dispersion into the air.

It is understood that what illustrated above purely represents possible non-limiting embodiments of the invention, which may vary in forms and arrangements without departing from the scope of the concept on which the invention is based. Any reference numbers in the appended claims are provided for the sole purpose of facilitating the reading thereof in the light of the description before and the accompanying drawings and do not in any way limit the scope of protection of the present invention.

The invention claimed is:

1. A process for air cooling of a liquid flowing in a pipe, the process comprising:

making the liquid flow inside an air/liquid heat exchanger in a single flowing direction, so that a heat exchange surface increases from an entrance of the liquid into the air/liquid heat exchanger to an exit of the liquid from the air/liquid heat exchanger, the air/liquid heat exchanger comprising at least one tube bundle;

making an air flow taken from an external environment flowing onto the heat exchange surface;

humidifying said air flow, inside at least one adiabatic or substantially adiabatic chamber, with vaporized or atomized water, said air flow being suitable to invest said vaporized or atomized water, before investing the air/liquid heat exchanger, to decrease an air flow temperature;

wetting a final portion of the heat exchange surface via a plurality of nozzles, said tube bundle comprising an entrance side, for said liquid to be cooled to enter said at least one tube bundle, and with an exit side, other than said entrance side, for said liquid to exit said at least one tube bundle, so that the liquid flows from said entrance side to said exit side in said single flowing direction, said wetting device being arranged along an end part of said tube bundle such that said wetting device wets said end part of said tube bundle, said tube bundle being a single-passage, and said liquid flowing in said at least one tube bundle in said single flowing direction from an inlet towards an outlet;

adjusting a wettable width of the heat exchange surface via an adjusting means, said adjusting means comprising independently adjustable valves to adjust fluid flowing to said nozzles.

2. The process according to claim 1, wherein only a portion of the heat exchange surface is wet forming a substantially homogeneous water film, said at least one tube bundle comprising one or more fins, said inlet being located opposite said outlet with respect to said single flowing direction.

3. The process according to claim 1, wherein said wettable width of the heat exchange surface is adjusted to regulate how much of the heat exchange surface shall be wet, said exit side being located opposite said entrance side with respect to said single flowing direction, said wetting device being configured to wet only a portion of said heat exchange surface.

4. The process according to claim 1, further comprising:

providing at least one module comprising a heat exchange section and a humidifying section;

providing a first evaporation filter arranged in said humidifying section;

providing a second evaporation filter arranged between said first evaporation filter and said tube bundle, said air flow passing from the humidifying section through said first evaporation filter and said second evaporation filter to said tube bundle, said wettable width via said adjusting means being set from a minimum or null dimension up to a maximum dimension different than an overall dimension of said heat exchange surface, said maximum dimension being less than said overall dimension of said heat exchange surface.

5. A convector for air cooling of a fluid flowing in a pipe, the convector comprising:

a path for a cooling air flow comprising an inlet from an external environment and an outlet towards the external environment;

a heat exchange section comprising at least one tube bundle defining a heat exchange surface, said heat exchange section being provided in said path for the cooling air flow;

a fan means for producing said cooling air flow along said path, so that said cooling air flow externally invests said at least one tube bundle on said heat exchange surface;

a humidifying section arranged in said path, upstream of said heat exchange section, where water is atomized to be invested by the cooling air flow;

a wetting device for wetting directly with water a portion of the heat exchange surface of said at least one tube bundle to further cool a portion of said at least one tube bundle, said wetting device comprising an adjusting means for regulating a wettable width of said portion of said heat exchange surface, so that said portion of said heat exchange surface can be wet from a minimum or null dimension up to a maximum dimension different than an overall dimension of said heat exchange surface of the at least one tube bundle, said wetting device comprising a plurality of nozzles, said adjusting means for regulating the wettable width comprising independently adjustable valves to adjust fluid flowing to said nozzles, said tube bundle comprising an entrance side, for said fluid to be cooled to enter said tube bundle, and with an exit side, other than said entrance side, for said fluid to exit said tube bundle, so that the fluid has an overall flowing direction from said entrance side to said exit side, said wetting device being arranged along an end part of said tube bundle such that said wetting device wets said end part of said tube bundle, said tube bundle being a single-passage, and said fluid flows in said tube bundle in a single direction from an inlet towards an outlet, wherein said heat exchange surface increases from said inlet of said fluid into the tube bundle to said exit of the fluid from said tube bundle.

6. The convector according to claim 5, wherein said nozzles are operatively connected to a hydraulic system and directed to wet only said portion of said at least one tube bundle.

7. The convector according to claim 5, wherein said nozzles are connected to a hydraulic system, each of said plurality of nozzles being configured to wet only a respective part of said heat exchange surface of the at least one tube bundle.

8. The convector according to claim 5, further comprising a control device for controlling a water flow supplied from at least one of said nozzles according to process parameters, said process parameters comprising at least one of temperature of a process fluid flowing in the at least one tube bundle measured at one or more points, air flow generated by said fan means, temperature and humidity of the external environment and humidity in said humidifying section, wherein said wetting device is configured to wet only said end part of said at least one tube bundle with respect to said overall flowing direction, wherein said end part is a portion of the heat exchange surface comprised between half of the at least one tube bundle and said exit side.

9. The convector according to claim 5, further comprising a managing device for managing an atomized water flow in said humidifying section according to process parameters, said process parameters comprising at least one temperature of a process fluid flowing in the at least one tube bundle measured at one or more points, air flow generated by said fan means, temperature and humidity of the external environment, humidity in said humidifying section and water flow supplied by said wetting device for wetting the at least one tube bundle.

10. The convector according to claim 5, further comprising an adjusting device for regulating the cooling air flow supplied by said fan means according to process parameters, said process parameters comprising at least one of temperature of a process fluid flowing in the at least one tube bundle measured at one or more points, temperature and humidity of the external environment, humidity in said humidifying section and water flow supplied by said wetting device for wetting the at least one tube bundle.

11. The convector according to claim 5, further comprising a recovery means for recovering the water coming from said wetting device, said recovery means comprising a supplying system for injecting recovered water into a humidifying system of said humidifying section.

12. The convector according to claim 5, further comprising:

a first evaporation filter arranged in said humidifying section;

a second evaporation filter arranged between said first evaporation filter and said tube bundle, said cooling air passing from the humidifying section through said first evaporation filter and said second evaporation filter to said tube bundle.

13. The convector according to claim 5, wherein said at least one tube bundle comprises one or more fins, the maximum dimension being less than the overall dimension of the heat exchange surface of the at least one tube bundle.

14. The convector according to claim 13, wherein said wetting device is configured to wet only said end part of said at least one tube bundle with respect to said overall flowing direction.

15. The convector according to claim 13, wherein said at least one tube bundle has flowing pipes comprised of fluid flowing segments that are all directed from the entrance side to the exit side of the at least one tube bundle, wherein said wetting device is configured to wet only a portion of said flowing pipes.

16. The convector according to claim 13, wherein said at least one tube bundle has flowing pipes comprised of fluid flowing segments that are all directed from the entrance side to the exit side of the at least one tube bundle, said flowing pipes being rectilinear, said wetting device being configured to wet only a portion of said flowing pipes.

17. The convector according to claim 5, wherein at least one of said nozzles wets the at least one tube bundle and said at least one of said nozzles and said at least one tube bundle are designed so that the water from said at least one of said nozzles wetting the at least one tube bundle creates a substantially homogeneous water film on the at least one tube bundle.

18. The convector according to claim 17, wherein said at least one tube bundle has a high-wettability surface coating allowing said homogeneous film to be formed.

19. The convector according to claim 17, wherein said at least one tube bundle has a high-wettability surface coating allowing said homogeneous film to be formed, said coating being a hydrophilic paint.

20. The convector according to claim 17, wherein said at least one tube bundle has a high-wettability surface coating allowing said homogeneous film to be formed, said coating being an acrylic type of hydrophilic paint.

21. The convector according to claim 5, further comprising:

a lower chamber defining said humidifying section, said lower chamber having two side inlets for intake of air from said external environment, and an outlet for said air exiting from said lower chamber towards said heat exchange section;

evaporation filters, each of said evaporation filters being associated with a respective one of said side inlet.

22. The convector according to claim 21, wherein said evaporation filters are arranged in a V shape, said evaporation filters being inclined upwards from a center of said lower chamber.

23. The convector according to claim 21, further comprising:

a second evaporation filter associated with said outlet.

24. The convector according to claim 21, further comprising an upper chamber defining said heat exchange section, said upper chamber being provided directly above said lower chamber.

* * * * *